United States Patent [19]

Brennan et al.

[11] 3,945,913

[45] Mar. 23, 1976

[54] MANUFACTURE OF LOWER AROMATIC COMPOUNDS

[75] Inventors: James A. Brennan, Cherry Hill; Roger A. Morrison, West Deptford, both of N.J.

[73] Assignee: Mobil Oil Corporation, New York, N.Y.

[22] Filed: Aug. 26, 1974

[21] Appl. No.: 500,432

[52] U.S. Cl. ..... 208/137; 208/64; 208/92; 208/135; 260/676 R; 260/672 R

[51] Int. Cl.[2] ..... C10G 35/06; C07C 3/58

[58] Field of Search ..... 208/64, 65, 92, 135, 137, 208/138, 139; 260/672 R, 672 T

[56] References Cited

UNITED STATES PATENTS

| | | | |
|---|---|---|---|
| 3,304,340 | 2/1967 | Noll | 260/672 R |
| 3,759,821 | 9/1973 | Brennan et al. | 208/138 |
| 3,761,389 | 9/1973 | Rollman | 208/64 |
| 3,790,471 | 2/1974 | Argauer et al. | 260/672 T |
| 3,856,872 | 12/1974 | Morrison | 260/672 T |
| 3,862,254 | 1/1975 | Eisenlohr et al. | 260/672 R |
| 3,873,439 | 3/1975 | Pollitzer | 208/66 |

*Primary Examiner*—Herbert Levine
*Attorney, Agent, or Firm*—C. A. Huggett

[57] ABSTRACT

Certain acidic heterogeneous catalysts produce large yields of benzene, toluene and xylene from alkyl aromatics of at least nine carbon atoms by a mechanism different from the classical disproportionation reaction characteristic of acid catalysts. These catalysts are characterized by a zeolite of the ZSM-5 type or zeolite ZSM-12 or zeolite ZSM-21. The reaction has the unique function of providing aliphatic by-products of higher molecular weight than is to be expected by splitting side chains from benzene rings. Typically, aromatic mixtures so derived from such charge stocks have unusually low content of ethyl benzene, thus greatly simplifying separation of xylene isomers.

33 Claims, 5 Drawing Figures

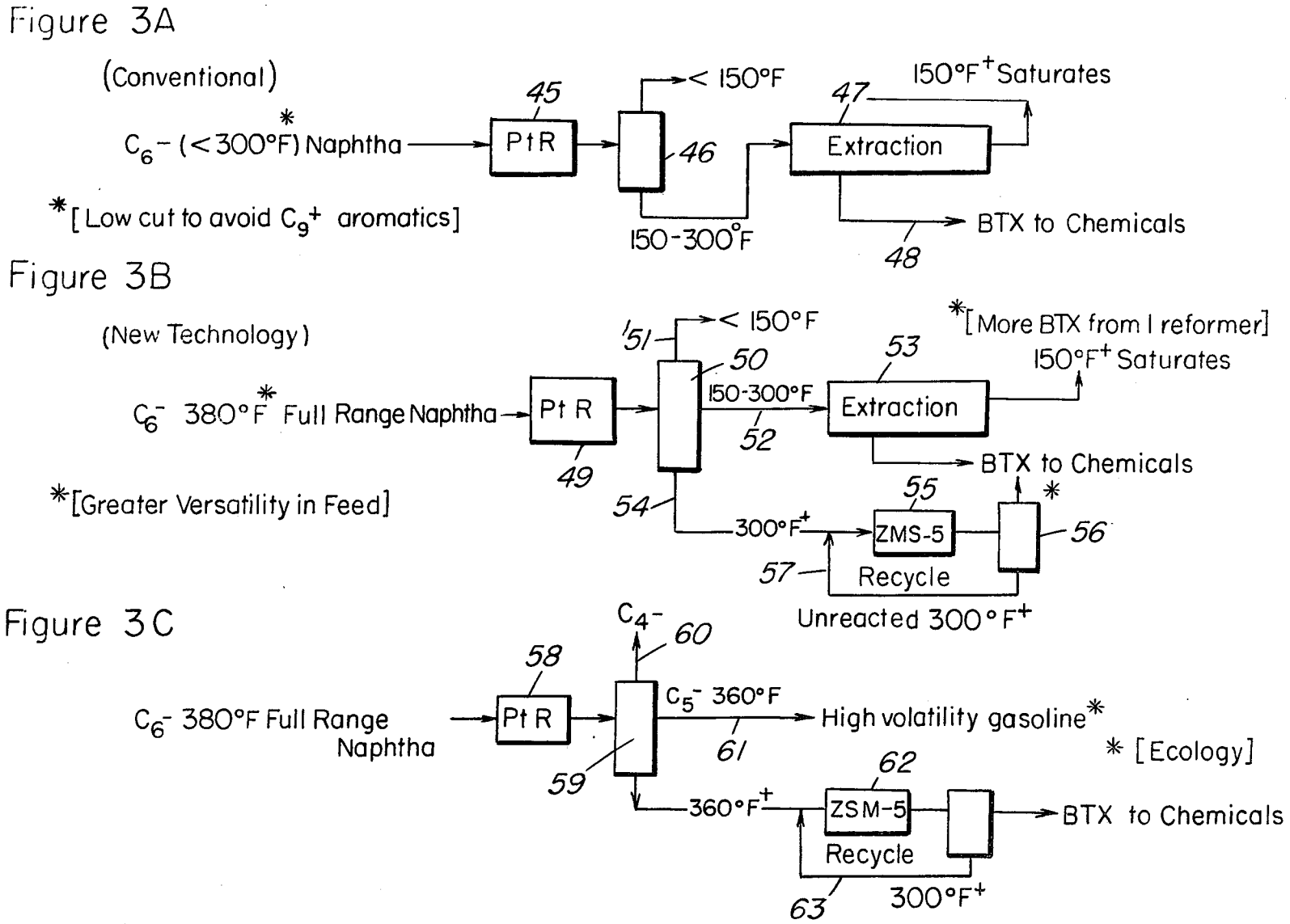
Figure 3A
(Conventional)
$C_6^-$ (<300°F) Naphtha
*[Low cut to avoid $C_9^+$ aromatics]
Pt R
45
46
< 150°F
150-300°F
Extraction
47
48
150°F+ Saturates
BTX to Chemicals
Figure 3B
(New Technology)
$C_6^-$ 380°F Full Range Naphtha
*[Greater Versatility in Feed]
Pt R
49
51
< 150°F
50
150-300°F
52
Extraction
53
*[More BTX from I reformer]
150°F+ Saturates
BTX to Chemicals
54
300°F+
ZMS-5
55
56
Recycle
57
Unreacted 300°F+
Figure 3C
$C_6^-$ 380°F Full Range Naphtha
Pt R
58
59
$C_4^-$
60
$C_5^-$ 360°F
61
High volatility gasoline
360°F+
ZSM-5
62
Recycle
63
300°F+
BTX to Chemicals
* [Ecology]

MANUFACTURE OF LOWER AROMATIC COMPOUNDS

BACKGROUND OF THE INVENTION

Of the aromatic compounds used in industry, benzene, toluene and xylenes are of outstanding importance on a volume basis. That mix of compounds, often designated BTX for convenience, is derived primarily from such aromatic naphthas as petroleum reformates and pyrolysis gasolines. The former result from processing petroleum naphthas over a catalyst such as platinum on alumina at temperatures which favor dehydrogenation of naphthenes. Pyrolysis gasolines are liquid products resulting from mild hydrogenation (to convert diolefins to olefins without hydrogenation of aromatic rings) of the naphtha fraction from steam cracking of hydrocarbons to manufacture ethylene, propylene, etc.

Regardless of aromatic naphtha source, it is usual practice to extract the liquid hydrocarbon with a solvent highly selective for aromatics to obtain an aromatic mixture of the benzene and alkylated benzenes present in the aromatic naphtha. That aromatic extract may then be distilled to separate benzene, toluene and $C_8$ aromatics from higher boiling compounds in the extract. The benzene and toluene are recovered in high purity but the $C_8$ fraction, containing valuable para xylene, is a mixture of the three xylene isomers with ethyl benzene. Techniques are known for separating p-xylene by fractional crystallization with isomerization of the other two isomers for recycle in a loop to the p-xylene separation. That operation is hampered by the presence of ethyl benzene (EB). However, a widely used xylene isomerization technique, "Octafining" can be applied. Octafining by passing the $C_8$ aromatics lean in p-xylene and mixed with hydrogen over platinum on silica-alumina not only isomerizes xylenes but also converts ethyl benzene, thus preventing build-up of EB in the separation-isomerization loop.

The manner of producing p-xylene by a loop including Octafining can be understood by consideration of a typical charge from reforming petroleum naphtha. The $C_8$ aromatics in such mixtures and their properties are:

| | Freezing Point °F. | Boiling Point °F. | Density Lbs./U.S. Gal. |
|---|---|---|---|
| Ethyl benzene | −139.0 | 277.1 | 7.26 |
| P-xylene | 55.9 | 281.0 | 7.21 |
| M-xylene | −54.2 | 282.4 | 7.23 |
| O-xylene | −13.3 | 292.0 | 7.37 |

Principal sources are catalytically reformed naphthas and pyrolysis distillates. The $C_8$ aromatic fractions from these sources vary quite widely in composition but will usually be in the range 10 to 32 wt.% ethyl benzene with the balance, xylenes, being divided approximately 50 wt.% meta, and 25 wt.% each of para and ortho.

In turn, calculated thermodynamic equilibria for the $C_8$ aromatic isomers at Octafining conditions are:

| Temperature | 850°F. |
|---|---|
| Wt.% Ethyl benzene | 8.5 |
| Wt.% para xylene | 22.0 |
| Wt.% meta xylene | 48.0 |
| Wt.% ortho xylene | 21.5 |

-continued

| | |
|---|---|
| TOTAL | 100.0 |

An increase in temperature of 50°F. will increase the equilibrium concentration of ethyl benzene by about 1 wt.%, ortho xylene is not changed and para and meta xylenes are both decreased by about 0.5 wt.%.

Individual isomer products may be separated from the naturally occurring mixtures by appropriate physical methods. Ethyl benzene may be separated by fractional distillation although this is a costly operation. Ortho xylene may be separated by fractional distillation and is so produced commercially. Para xylene is separated from the mixed isomers by fractional crystallization.

As commercial use of para and ortho xylene has increased there has been interest in isomerizing the other $C_8$ aromatics toward an equilibrium mix and thus increasing yields of the desired xylenes.

Octafining process operates in conjunction with the product xylene or xylenes separation processes. A virgin $C_8$ aromatics mixture is fed to such a processing combination in which the residual isomers emerging from the product separation steps are then charged to the isomerizer unit and the effluent isomerizate $C_8$ aromatics are recycled to the product separation steps. The composition of isomerizer feed is then a function of the virgin $C_8$ aromatic feed, the product separation unit performance, and the isomerizer performance.

The isomerizer unit itself is most simply described as a single reactor catalytic reformer. As in reforming, the catalyst contains a small amount of platinum and the reaction is carried out in a hydrogen atmosphere.

Octafiner unit designs recommended by licensors of Octafining usually lie within these specification ranges:

| Process Conditions | |
|---|---|
| Reactor Pressure | 175 to 225 PSIG |
| Reactor Inlet Temperature Range | 830–900°F. |
| Heat of Reaction | Nil |
| Liquid Hourly Space Velocity | 0.6 to 1.6 Vol/Vol/Hr. |
| Number of Reactors, Downflow | 1 |
| Catalyst Bed Depth, Feet | 11 to 15 |
| Catalyst Density, Lb/Cu. Ft. | 38 |
| Recycle Circulation, Mols Hydrogen/Mol Hydrocarbon Feed | 7.0 to 14.0 |
| Maximum Catalyst Pressure Drop, PSI | 20 |

It will be apparent that under recommended design conditions, a considerable volume of hydrogen is introduced with the $C_8$ aromatics. In order to increase throughput, there is great incentive to reduce hydrogen circulation with consequent increase in aging rate of the catalyst. Aging of catalyst occurs through deposition of carbonaceous materials on the catalyst with need to regenerate by burning off the coke when the activity of the catalyst has decreased to an undesirable level. Typically the recommended design operation will be started up at about 850°F. with reaction temperature being increased as needed to maintain desired level of isomerization until reaction temperature reaches about 900°F. At that point the isomerizer is taken off stream and regenerated by burning of the coke deposit.

A typical charge to the isomerizing reactor may contain 17 wt.% ethyl benzene, 65 wt.% m-xylene, 11 wt.% p-xylene and 7 wt.% o-xylene. The thermodynamic equilibrium varies slightly with temperature. The objective in the isomerization reactor is to bring the charge as near to theoretical equilibrium concentrations as may be feasible consistent with reaction times which do not give extensive cracking and disproportionation.

Ethyl benzene reacts through ethyl cyclohexane to dimethyl cyclohexanes which in turn equilibrate to xylenes. Competing reactions are disproportionation of ethyl benzene to benzene and diethyl benzene, hydrocracking of ethyl benzene to ethane and benzene and hydrocracking of the alkyl cyclohexanes.

The rate of ethyl benzene approach to equilibrium concentration in a $C_8$ aromatic mixture is related to effective contact time. Hydrogen partial pressure has a very significant effect on ethyl benzene approach to equilibrium. Temperature change within the range of Octafining conditions (830° to 900°F.) has but a very small effect on ethyl benzene approach to equilibrium.

Concurrent loss of ethyl benzene to other molecular weight products relate to % approach to equilibrium. Products formed from ethyl benzene include $C_6$+ naphthenes, benzene from cracking, benzene and $C_{10}$ aromatics from disproportionation, and total loss to other than $C_8$ molecular weight. $C_5$ and lighter hydrocarbon by-products are also formed.

The three xylenes isomerize much more selectively than does ethyl benzene, but they do exhibit different rates of isomerization and hence, with different feed composition situations the rates of approach to equilibrium vary considerably.

Loss of xylenes to other molecular weight products varies with contact time. By-products include naphthenes, toluene, $C_9$ aromatics and $C_5$ and lighter hydrocracking products.

Ethyl benzene has been found responsible for a relatively rapid decline in catalyst activity and this effect is proportional to its concentration in a $C_8$ aromatic feed mixture. It has been possible then to relate catalyst stability (or loss in activity) to feed composition (ethyl benzene content and hydrogen recycle ratio) so that for any $C_8$ aromatic feed, desired xylene products can be made with a selected suitably long catalyst use cycle.

Because of its behavior in the loop for manufacture of p-xylene, or other xylene isomer, ethyl benzene is undesirable in the feed but is tolerated because of the great expense of removal from mixed $C_8$ aromatics. Streams substantially free of ethyl benzene are available from such processes as transalkylation of aromatics having only methyl substituents. Thus toluene can be reacted with itself (the specific transalkylation reaction sometimes called "disproportionation") or toluene may be reacted with tri-methyl benzene in known manner. Improved catalysts for these reactions are described in copending application Ser. No. 431,519, filed Jan. 7, 1974 now abandoned.

The transalkylation reactions provide means for utilizing the higher boiling aromatics separated in preparing BTX from reformates. Thus toluene may by reacted with tri-methyl benzenes to produce xylenes. They are also useful in handling high boiling aromatics formed by side reactions in such processes as isomerization of xylenes.

These conventional techniques make BTX available for the chemical industry by removing light aromatics from the "gasoline pool" of the petroleum fuels industry. This is an unfortunate result, particularly under present trends for improvement of the atmosphere by steps to reduce hydrocarbon and lead emissions from internal combustion engines used to power automotive equipment.

By far the greatest amount of unburned hydrocarbon emissions from cars occurs during cold starts while the engine is operating below design temperature. It has been contended that a more volatile motor fuel will reduce such emissions during the warm-up period. In addition, the statutory requirements for reduction and ultimate discontinuance of alkyl lead anti-knock agents require that octane number specifications be met by higher content of high octane number hydrocarbons in the motor fuel.

The net effect of the trends in motor fuel composition for environmental purposes is increased need for light aromatics to provide high volatility and octane number for motor gasoline. Present practices for supply of BTX to the chemical industry run counter to the needs of motor fuel supply by removing the needed light aromatics from availability for gasoline blending.

It is known that acid zeolites are very effective for disproportionation of alkyl aromatic compounds. See Frilette et al. U.S. Pat. No. 3,506,731, Wallace et al. U.S. Pat. No. 3,808,284 and Inoue et al. U.S. Pat. No. 3,671,602. The latter has shown that heavier aromatics, e.g. tri-methyl benzenes may be disproportionated to BTX and $C_{10}$+ aromatics. The problem with that course is that a substantial portion of the product is $C_{10}$+ aromatics which boil >350°F., which is at the upper limit or above the gasoline range and has little or no value as chemicals.

It is apparent that need exists for a process which will satisfy the BTX demand without removing those compounds from gasoline blending stocks.

SUMMARY OF THE INVENTION

That need is met by the process of this invention which, in its preferred embodiments comprises modification of petroleum refinery operation to remove the $C_9$+ fraction of catalytic reformate for processing to BTX and using the lighter fraction of reformate in blending of motor fuel. By this means, high front end volatility and octane number are preserved for gasoline. In its broader aspect, the invention contemplates manufacture of BTX from alkyl benzenes of nine or more carbon atoms by processing over unique acid zeolite catalysts, hereinafter described, in the presence of hydrogen.

The high boiling aromatics, nine carbon atoms or more, are convertible to BTX over catalyst characterized by acid zeolite of the ZSM-5 type, zeolite ZSM-12 or zeolite ZSM-21. That the reaction is not simply dealkylation is clear from the fact that the aliphatic byproducts include large amounts of paraffins having more carbon atoms than the alkyl side chains of the aromatics charged. The process of the invention is conducted at 550° to 1000°F. under pressures of 100 to 2000 pounds per square inch in the presence of 0.5 to 10 mols of hydrogen per mol of hydrocarbon charge. Since the preferred catalysts are composites of zeolite with relatively inert porous matrix, the space velocity is best related to weight of active zeolite in the catalyst. Weight hourly space velocities on that basis between 0.5 and 200 are suitable.

The charge for the preferred embodiment of producing BTX (while making gasoline having good front end volatility, high octane number and low heavy end content) is here designated "$C_9$+ reformate". As is well known in the petroleum refining art, this does not normally define a fraction free of lighter material. Petroleum refinery fractionation is relatively imprecise, being designed to produce distillate and bottom cuts of desired boiling range. The invention is intended for use in conventional equipment of petroleum refineries and therefore contemplates "sloppy" fractionation. The term $C_9$+ reformate as used herein means a fraction which contains most of the $C_9$ aromatics in the reformate and substantially all of the heavier aromatics present in the reformate. In general, the $C_9$+ reformate will contain 20% by weight or less of xylenes.

It is a characteristic feature of catalytic reforming that the heavy end contemplated for use in this invention is very low in aliphatic components. A very high proportion of the alkyl carbon atom content is constituted by alkyl substituents on aromatic rings. To a major extent, those side chains have been reduced to methyl groups. A moderate amount of ethyl groups are present and a few propyl and butyl groups are also seen in a typical heavy reformate. Longer alkyl chains are so minor that they can be disregarded. A principal reaction appears to be rearrangement and removal of methyl groups and removal of those few higher alkyl side chains present in the charge.

The course of the conversion necessarily results in production of aliphatic hydrocarbons in reducing higher alkyl aromatics to BTX. Surprisingly, the alkyl compounds in the reaction product are predominantly longer chains that the substituents on the rings in the charge. This characteristic of the reaction is extremely valuable in a process conducted under hydrogen as is the process of this invention. A molar excess of hydrogen is preferred. In order to achieve maximum economy of operation, hydrogen is separated from the product and recycled to the inlet of the reactor. Methane, being difficult to separate from hydrogen without expensive cryogenic equipment, tends to build up in the recycle hydrogen and requires that a portion of the recycle stream be withdrawn to maintain adequate hydrogen purity. That withdrawn stream in other processes using hydrogen, e.g. catalytic reforming, is of value only for fuel. Such degradation of hydrogen value is obviated in large measure by the present process because of the low methane concentration in the reactor effluent.

Although $C_9$+ reformate is the preferred commercial feedstock for this process, it is obvious that other sources of $C_9$+ aromatic concentrates comprised primarily of $C_1$ and $C_2$ alkylbenzenes will serve as well. One such source is pyrolysis gasoline from the production of ethylene.

It is noted further that the yield of aliphatics boiling in the BTX range is nil, thus providing high purity aromatic products.

BRIEF DESCRIPTION OF THE DRAWINGS

Preferred embodiments of the invention are illustrated by the annexed drawings wherein:

FIG. 3 is constituted by three flow sheets for comparative purposes:

Figure 1:
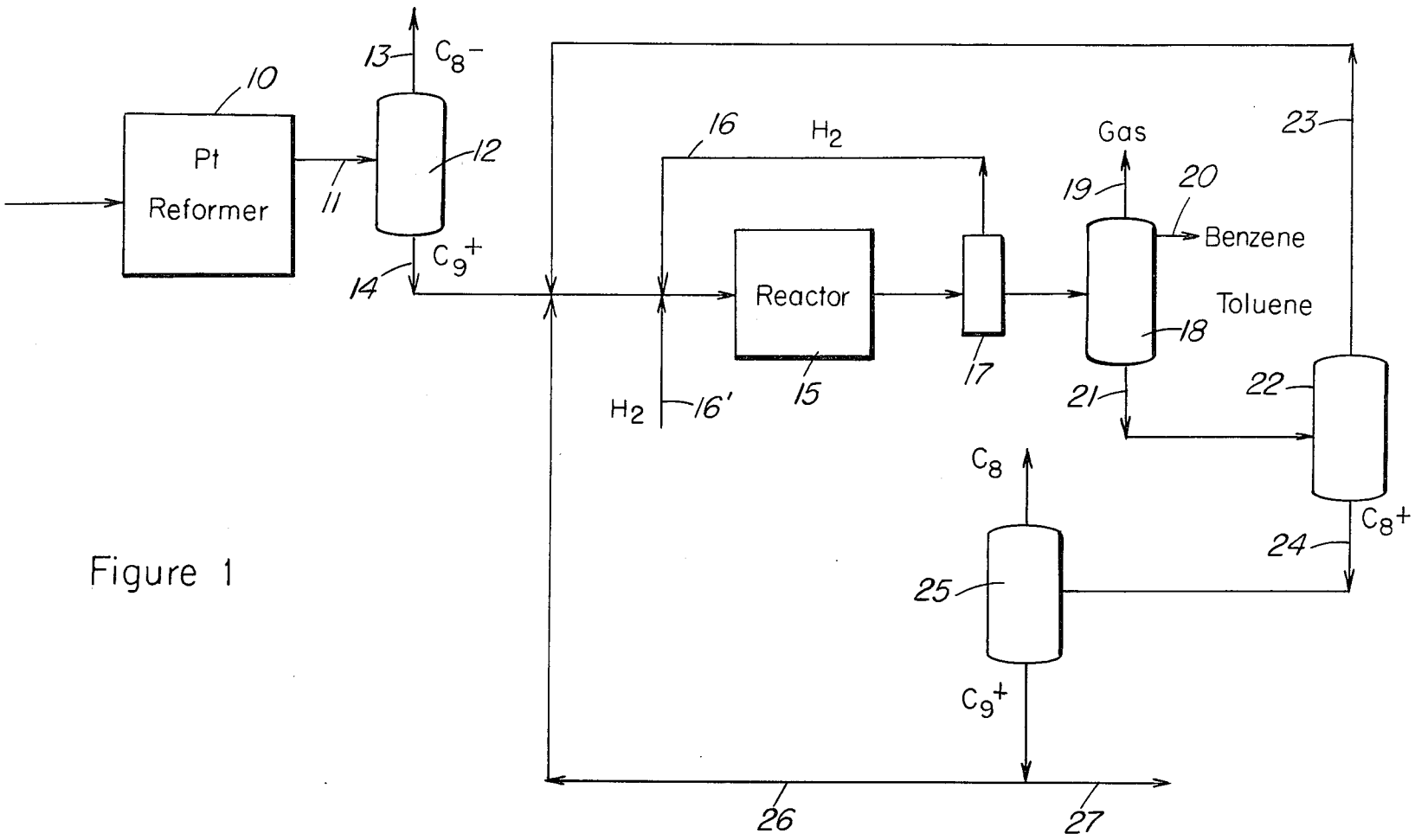
FIG. 1 is a flow sheet of combined motor fuel manufacture and production of BTX according to the invention.

3A represents conventional practice in manufacture of BTX;

3B illustrates application of the present invention for maximum BTX; and 3C is a simplication of FIG. 1.

DESCRIPTION OF SPECIFIC EMBODIMENTS

As stated, the catalyst used according to the invention is characterized by specific zeolites. Zeolites of the ZSM-5 type include zeolite ZSM-5 as described in Argauer and Landolt U.S. Pat. No. 3,702,886, dated Nov. 14, 1972 and zeolite ZSM-11 as described in Chu U.S. Pat. No. 3,709,979 dated Jan. 7, 1973 and variants thereof. Zeolite ZSM-12 is described in German Offenlegungsschrift No. 2213109.

Preparation of synthetic zeolite ZSM-21 is typically accomplished as follows: A first solution comprising 3.3 g. sodium aluminate (41.8% $Al_2O_3$, 31.6% $NA_2O$ and 24.9% $H_2O$), 87.0 g. $H_2O$ and 0.34 g. NaOH (50% solution with water) was prepared. The organic material pyrrolidine was added to the first solution in 18.2 g. quantity to form a second solution. Thereupon, 82.4 g. colloidal silica (29.5% $SiO_2$ and 70.5% $H_2O$) was added to the second solution and mixed until a homogeneous gel was formed. This gel was composed of the following components in mole ratios:

| | |
|---|---|
| $\frac{R^+}{R^+ + M'}$ | 0.87, wherein *M* is sodium and *R* is the pyrrolidine ion. |
| $\frac{OH^-}{SiO_2}$ | 0.094 (Not including any contribution of $OH^-$ from pyrrolidine). |
| $\frac{H_2O}{OH^-}$ | 210 (Not including any contribution of $OH^-$ from pyrrolidine). |
| $\frac{SiO_2}{Al_2O_3}$ | 30.0 |

The mixture was maintained at 276°C. for 17 days, during which time crystallization was complete. The product crystals were filtered out of solution and water washed for approximately 16 hours on a continuous wash line.

X-ray analysis of the crystalline product proved the crystals to have a diffraction patterns as shown in Table I.

TABLE I

| d (A) | I/Io |
|---|---|
| 9.5 ± 0.30 | Very Strong |
| 7.0 ± 0.20 | Medium |
| 6.6 ± 0.10 | Medium |
| 5.8 ± 0.10 | Weak |
| 4.95 ± 0.10 | Weak |
| 3.98 ± 0.07 | Strong |
| 3.80 ± 0.07 | Strong |
| 3.53 ± 0.06 | Very Strong |
| 3.47 ± 0.05 | Very Strong |
| 3.13 ± 0.05 | Weak |
| 2.92 ± 0.05 | Weak |

Chemical analysis of the crystalline product led to the following compositional figures:

| Composition | Wt.% | Mole Ratio on $Al_2O_3$ Basis |
|---|---|---|
| N | 1.87 | — |
| Na | 0.25 | — |
| $Al_2O_3$ | 5.15 | 1.0 |
| $Si_02$ | 90.7 | 29.9 |
| $N_2O$ | — | 1.54 |
| $Na_2O$ | — | 0.11 |
| $H_2O$ | — | 9.90 |

Physical analysis of the crystalline product calcined 16 hours at 1000°F. showed it to have a surface area of 304 $m^2/g$ and adsorption tests produced the following results:

| Adsorption | Wt.% |
|---|---|
| Cyclohexane | 1.0 |
| n-hexane | 5.4 |
| Water | 9.0 |

In determining the sorptive capacities, a weighed sample of zeolite was heated to 600°C. and held at that temperature until the evolution of basic nitrogeneous gases ceased. The zeolite was then cooled and the sorption test run at 12 mm for water and 20 mm for hydrocarbons.

Zeolite ZSM-21 is the subject of copending application Ser. No. 358,192, filed May 7, 1973 now abandoned.

These new catalysts are characterized by very good stability as well as very high activity and selectivity in many hydrocarbon reactions.

The characterizing feature of the catalyst according to this invention is ZSM-5 type of zeolite as described in said U.S. Pat. Nos. 3,702,886, Argauer et al., and 3,709,979, Chu, and ZSM-12 as described in German Offenlegungsschrift No. 2213109 the disclosures of which are hereby incorporated by reference. The invention also contemplates use of ZSM-21 as hereinabove described. The most active forms for the present purpose are those in which cationic sites are occupied at least in part by protons, sometimes called the "acid form". As described in the Argauer et al., and Chu patents, and the German Offenlegungsschrift the acid form is achieved by burning out the organic cations. Protons may also be introduced by base exchange with ammonium or amine cations and calcination to decompose the ammonium or substituted ammonium cation.

Preferably, the catalyst also includes a metal having hydrogenation capability such as the metals of Group VIII of the Periodic Table, plus chromium, tantalum, tungsten, vanadium, gold and the like which will enhance selectivity to benzene at the higher temperatures of the range contemplated. Preferred metals for this purpose are nickel and cobalt. These metals may be introduced by base exchange or impregnation. In general, the selected metal should be chosen with regard to reaction temperature contemplated. Platinum can be used at high temperatures above about 800°F. which favors dehydrogenation of benzene rings. At lower temperatures, platinum will result in saturation of rings and destruction of product. Nickel can be used effectively at those lower temperatures.

The zeolite is preferably incorporated in a porous matrix to provide mechanical strength, preferably alumina. The hydrogenation metal may be added after incorporation with the zeolite in a matrix, the only essential feature being that metal sites be in the vicinity of the zeolite, preferably within the same particle.

Temperatures for the catalyst used according to this invention may vary depending upon design factors of the equipment. Generally these lie between 550°F. and 1000°F. Pressures will also be dictated, at least in part, by design factors of the equipment and may vary from 100 to 2000 lb. per square inch gauge.

In general, a temperature will be chosen which suits commercial needs at a particular place and time. It is generally true that higher temperatures tend to increase the yield of benzene. Note particularly the data at different temperatures in Tables IV and VI, below. Based on these data, it will be clear that a temperature can be chosen to maximize either benzene or xylenes.

In this connection, it is noted again that the temperature of reaction is related to character of the hydrogenation metal, if any, on the catalyst. Many prior art aromatic processing catalysts employ a metal of the platinum group. These are very potent hydrogenation catalysts. At temperatures much below 800°F., hydrogenation of the ring destroys greater amounts of product, the more the temperature is reduced. At the higher temperatures, thermodynamic equilibria favor the benzene ring. The present catalysts are effective with such metals as nickel which give negligible ring hydrogenation at the lower temperatures here possible. In general, it is preferred to use these less potent metal catalysts in this invention to afford temperature flexibility with consequent capability for high throughput.

Space velocities are calculated with respect to the active component of ZSM-5 type or ZSM-12or ZSM-21 zeolite. For example, the catalyst may be a composite of 65% ZSM-5 and 35% alumina, by weight. Space velocities are calculated with respect to that 65% constituted by active zeolite. So calculated, the space velocities may vary from about 0.1 to about 200 on a weight basis, preferably 0.5 to 10.

The process requires the presence of hydrogen. Preferably, the smallest amount of hydrogen consistent with the desired rate and selectivity of conversion and with adequate catalyst life between regenerations will be selected to minimize the load on compressors, heat exchangers, etc. The hydrogen admixed with charge will generally lie between about 0.5 and 10 mols of hydrogen per mol of hydrocarbon charge.

Severity of the reaction is a function of both temperature and space velocity. Excessive severity will result in undue cracking of the charge. Insufficient severity may permit build up of $C_{10}$+ aromatics through $C_9$+ disproportionation-type reactions, see Example 1. Thus, the two factors should be adjusted in relationship to each other. For example, space velocities in the lower part of the claimed range will indicate lower temperatures of reaction, and vice versa.

The nature of the conversion obtained will be apparent from examples presented below.

EXAMPLE 1

The character of the invention for conversion of alkyl aromatic mixtures containing primarily methyl and ethyl substituted aromatics is best seen in comparison against the course of reaction of n-propyl benzene with a catalyst according to the invention. The catalyst employed was 65% acid ZSM-5 in an alumina matrix. Two runs were made at different conditions. Space velocities are reported on a weight basis in Table II with respect to the zeolite only in each case. The specified charge was admixed with hydrogen in the molar proportions shown by the value given for "$H_2$/HC". Yields of products and by-products are shown in the Table. In each case, yields are supplied for products on two bases.

TABLE II

| CHARGE | n-PROPYLBENZENE | |
|---|---|---|
| Temperature, °F. | 600 | 700 |
| Pressure, psig | 400 | 400 |
| WHSV | 7.5 | 22.5 |
| $H_2$/HC | 3/1 | 3/1 |
| $C_9$ Converted (Wt.%) | 76 | 91 |
| Material Balance (%) | 98 | 101 |
| Products, Wt.% | | |
| $C_1 + C_2$ | 0.2 | 0.4 |
| $C_3$ | 4 | 7 |
| $C_4$ | 6 | 8.5 |
| $C_5$+ paraffins | 4 | 5 |
| Benzene | 38 | 45 |
| Toluene | 2 | 4 |
| Xylenes | 4 | 9 |
| $C_9$ Aromatics | 24 | 9 |
| $C_{10}$+ Aromatics | 18 | 12 |

Of particular interest among the data in Table II are the relatively high yields of $C_4$ and heavier paraffins and the yields of the methyl benzenes, via. toluene and xylenes. Dealkylation would result in propane and benzene. Cracking of the side chain of three carbon atoms could produce toluene and xylenes plus equivalent amounts of methane, ethane or both, but the yield of $C_1$ and $C_2$ compounds is very minor.

The BTX is suited for fractionation and processing to desired valuable products with low EB to facilitate the isolation of desired xylene isomers. The disadvantage is the high yield of $C_{10}$+ aromatics by disproportionation at these mild conditions.

The paraffinic by-products are predominantly heavier than $C_2$ and thus have value greater than that of fuel gas. Propane is the principal ingredient of bottled gas (LPG), while butane and heavier materials are gasoline components.

EXAMPLE 2

The preceding example is not illustrative of nature of the invention because the charge is a single, long chain $C_9$ aromatic. Dramatic contrasts are seen when its charge is a fraction available at commercial installations. The $C_9$+ cut left after commercial style fractionation to prepare BTX from reformate will contain some xylene but will be essentially free of the lowest boiling $C_8$ aromatic (ethyl benzene). The $C_9$ (predominant) portion will contain trimethyl benzenes, ethyl methyl benzenes and some propylbenzenes. A typical such fraction containing 10 wt.% xylene, 69 wt.% $C_9$ aromatics and 21 wt.% $C_{10}$ and heavier aromatics was the charge in a conversion over a catalyst of 65 wt.% acid-nickel ZSM-5 composited with 35 wt.% of alumina matrix. The catalyst contained 0.6 wt.% nickel. Reaction conditions and yields are shown in Table III.

TABLE III

| CHARGE | $C_9$+ REFORMATE AROMATICS |
|---|---|
| Temperature, °F. | 700 |
| Pressure, psig | 600 |
| WHSV | 1.0 |
| $H_2$/HC | 4/1 |
| $C_9$+ Converted (Wt.%) | 65 |
| Material Balance (%) | 99 |
| Products, Wt.% | |
| $C_1 + C_2$ | 1.5 |
| $C_3$ | 10 |
| $C_4$ | 2 |

TABLE III-continued

| | |
|---|---|
| $C_5$+ paraffins | — |
| Benzene | 4 |
| Toluene | 19 |
| Ethylbenzene | 2 |
| Xylenes | 29 |
| $C_9$ Aromatics | 27 |
| $C_{10}$+ Aromatics | 5.5 |

Note should be taken of the high yield of valuable propane and sharp increase in $C_8$ aromatic content with low EB.

EXAMPLE 3

A series of runs were conducted in which the charge was 318°–349°F. cut from the full range commercial reformate. The catalyst was a nickel acid ZSM-5 of 70 silica/alumina ratio composited with 35 weight percent of alumina binder. The composite was extruded and calcined to provide the final catalyst. Table IV below shows reaction conditions and product distribution as determined by analysis of samples taken on stream. The charge was constituted as follows:

| | WEIGHT PERCENT |
|---|---|
| m- and p-xylenes | 5.8 |
| o-xylenes | 3.7 |
| $C_9$ Non-aromatics | 0.6 |
| $C_9$ Aromatics | 69.2 |
| $C_{10}$ Aromatics | 19.4 |
| $C_{11}$–$C_{12}$ Aromatics | 1.3 |

TABLE IV

REACTING OF $C_9$–$C_{10}$ REFORMATE AROMATICS OVER NiHZSM-5

| EXAMPLE | 3A | 3B | 3C | 3D |
|---|---|---|---|---|
| Temperature, °F. | 754 | 725 | 775 | 701 |
| Pressure, psig | 600 | 610 | 610 | 615 |
| WHSV | 1.0 | 1.0 | 1.0 | 1.0 |
| $H_2$/HC | 4/1 | 4/1 | 4/1 | 4/1 |
| Product Distribution, Wt.% | | | | |
| $C_1$ Non Aromatic | 0.6 | 0.3 | 0.9 | 0.02 |
| $C_2$'s Non Aromatic | 4.6 | 2.8 | 4.9 | 1.5 |
| $C_3$'s Non Aromatic | 12.3 | 12.3 | 13.2 | 10.2 |
| $C_4$'s Non Aromatic | 2.3 | 2.9 | 2.1 | 1.8 |
| $C_5$'s Non Aromatic | 0.3 | 0.6 | 0.2 | 0.2 |
| $C_6$'s Non Aromatic | — | — | — | — |
| Benzene | 5.1 | 4.8 | 5.3 | 3.8 |
| $C_7$'s Non Aromatic | — | — | — | — |
| Toluene | 22.4 | 20.7 | 22.9 | 19.1 |
| $C_8$'s Non Aromatic | 0.06 | 0.05 | — | — |
| Ethyl benzene | 1.5 | 1.7 | 1.4 | 1.9 |
| m- and p-xylene | 22.9 | 22.1 | 22.2 | 22.9 |
| o-xylene | 7.4 | 6.8 | 7.0 | 6.8 |
| $C_9$'s Non Aromatic | — | — | — | — |
| $C_9$'s Aromatics | 17.8 | 20.9 | 15.9 | 27.2 |
| $C_{10}$'s Aromatics | 0.6 | 1.4 | 0.8 | 1.8 |
| $C_{11}$+ Aromatics | 2.2 | 2.7 | 3.1 | 2.7 |
| Total Wt.% Conversion | 70.9 | 67.0 | 72.5 | 60.1 |
| Wt.% Reacted | | | | |
| $C_9$ Aromatics | 74.3 | 69.8 | 77.0 | 60.6 |
| $C_{10}$ Aromatics | 97.1 | 93.0 | 95.9 | 90.6 |
| Wt.% $C_1$–$C_5$ Made | 20.1 | 18.9 | 21.4 | 13.8 |
| Wt.% Xylenes Made | 20.9 | 19.5 | 19.7 | 20.1 |

| EXAMPLE | 3E | 3F | 3G |
|---|---|---|---|
| Temperature, °F. | 801 | 651 | 602 |
| Pressure, psig | 595 | 600 | 615 |
| WHSV | 1.0 | 1.0 | 1.0 |
| $H_2$/HC | 4/1 | 4/1 | 4/1 |
| Product Distribution, Wt.% | | | |
| $C_1$ Non Aromatic | 1.1 | — | — |
| $C_2$'s Non Aromatic | 5.9 | 0.8 | 0.2 |
| $C_3$'s Non Aromatic | 12.7 | 9.5 | 7.4 |
| $C_4$'s Non Aromatic | 0.7 | 2.3 | 2.4 |

TABLE IV-continued

REACTING OF $C_9$–$C_{10}$ REFORMATE AROMATICS OVER NiHZSM-5

| EXAMPLE | 3A | 3B | 3C | 3D |
|---|---|---|---|---|
| $C_5$'s Non Aromatic | 0 | 0.3 | 0.3 | |
| $C_6$'s Non Aromatic | — | — | — | |
| Benzene | 5.5 | 3.2 | 2.1 | |
| $C_7$'s Non Aromatic | — | — | — | |
| Toluene | 25.2 | 17.7 | 14.3 | |
| $C_8$'s Non Aromatic | — | — | — | |
| Ethyl benzene | 1.2 | 1.7 | 2.9 | |
| m- and p-xylene | 23.1 | 21.6 | 15.7 | |
| o-xylene | 6.8 | 5.6 | 3.6 | |
| $C_9$'s Non Aromatic | — | — | — | |
| $C_9$'s Aromatics | 16.2 | 33.4 | 45.6 | |
| $C_{10}$'s Aromatics | 0.3 | 3.0 | 5.2 | |
| $C_{11}$+ Aromatics | 1.2 | 0.93 | 0.2 | |
| Total Wt.% Conversion | 72.8 | 53.2 | 39.5 | |
| Wt.% Reacted | | | | |
| $C_9$ Aromatics | 76.6 | 51.7 | 34.1 | |
| $C_{10}$ Aromatics | 98.5 | 84.5 | 73.0 | |
| Wt.% $C_1$–$C_5$ Made | 20.4 | 12.8 | 10.4 | |
| Wt.% Xylenes Made | 20.5 | 17.8 | 9.8 | |

From the above tabulation it will be seen that the use of $C_9$+ aromatics offers an attractive route to xylenes, much more so than the practice recently followed in the art of disproportionation of toluene. BTX substantially free of saturates can be made from the $C_9$+ aromatics concentrate derived by fractionation of reformate without the expensive extraction step commonly practiced today in making BTX from reformates.

The by-products are low in $C_1$ and $C_2$ paraffins despite the fact that the side chains of the charge are primarily methyl and ethyl groups. In addition to the advantage from greater value for propane, the hydrogen consumption is sharply reduced below that required to saturate $C_1$ and $C_2$ radicals. The low content of $C_4$+ paraffins facilitates purification of benzene.

Note particularly the sharp reduction of $C_{10}$+ (350°F.+) aromatics instead of increase expected of conventional transalkylation and disproportionation reactions. Such heavy aromatics impart poor volatility and poor engine cleanliness characteristics to gasolines. It will be shown that $C_9$+ aromatics in the product can be recycled with toluene to the feed in order to optimize benzene and xylene production. It appears there is no significant buildup of $C_{10}$+ aromatics in the loop when such recycle is practiced.

EXAMPLE 4

The feasibility of charging toluene and $C_9$+ aromatics as recycle in the process of this invention was demonstrated by charging a 50-50 molar blend of toluene and $C_9$–$C_{10}$ aromatics over NiHZSM at one hourly space velocity, 600 psig and a 4 to 1 hydrogen/hydrocarbon molar ratio. The results summarized below in Table V show that ring loss is reduced from 10 weight percent to 2 weight percent and conversion goes from 53 to 37% while xylene production remains almost constant over the range of 830 to 700°F.

TABLE V

| | | |
|---|---|---|
| Temperature | 830 | 698 |
| Conversion, Wt.% | 52.5 | 37.2 |
| Wt.% Reacted | | |
| Toluene | 24.1 | 15.2 |
| $C_9$ Aromatics | 79.3 | 55.4 |
| Ring Loss | 9.8 | 2.2 |
| Wt.% Xylenes Made | 23.0 | 21.9 |

More detail on this type of reaction is shown in Table VI in which the catalyst was the same as that described in Example 3. The charge was constituted as follows:

| | WEIGHT PERCENT |
|---|---|
| Toluene | 44.4 |
| $C_8$ Non Aromatics | 0.05 |
| Ethyl benzene | 0.3 |
| m- and p-xylene | 2.9 |
| o-xylene | 2.0 |
| $C_9$ Non Aromatics | 0.1 |
| $C_9$ Aromatics | 38.9 |
| $C_{10}$ Aromatics | 9.4 |
| $C_{11}$–$C_{12}$ Aromatics | 1.9 |

TABLE VI

TRANSALKYLATION OF TOLUENE AND $C_9$–$C_{10}$ AROMATICS OVER Ni-ZSM-5

| EXAMPLE | 4A | 4B | 4C | 4D |
|---|---|---|---|---|
| Temperature, °F. | 830 | 825 | 812 | 778 |
| Pressure, psig | 605 | 605 | 615 | 600 |
| WHSV | 1.0 | 1.0 | 1.0 | 1.0 |
| $H_2$/HC | 4/1 | 4/1 | 4/1 | 4/1 |
| Product Distribution, Wt.% | | | | |
| $C_1$ Non Aromatics | 1.4 | 1.0 | 0.9 | 0.4 |
| $C_2$'s Non Aromatics | 8.4 | 5.1 | 4.9 | 3.3 |
| $C_3$'s Non Aromatics | 7.3 | 6.6 | 6.8 | 6.6 |
| $C_4$'s Non Aromatics | 0.7 | 0.7 | 0.7 | 1.0 |
| $C_5$'s Non Aromatics | — | 0.03 | 0.03 | 0.08 |
| $C_6$'s Non Aromatics | — | — | — | — |
| Benzene | 11.3 | 11.3 | 11.2 | 9.9 |
| $C_7$'s Non Aromatics | — | — | — | — |
| Toluene | 33.7 | 34.6 | 34.9 | 35.7 |
| $C_8$'s Non Aromatics | 0.05 | 0.13 | 0.06 | 0.03 |
| Ethyl benzene | | 1.5 | 1.3 | 1.4 |
| | 21.3* | | | |
| m- and p-xylene | | 20.8 | 21.3 | 21.6 |
| o-xylene | 6.6 | 6.8 | 6.9 | 6.9 |
| $C_9$'s Non Aromatics | — | — | — | — |
| $C_9$'s Aromatics | 8.0 | 9.4 | 9.5 | 11.5 |
| $C_{10}$'s Aromatics | 0.8 | 1.1 | 1.0 | 1.2 |
| $C_{11}$+ Aromatics | 0.4 | 0.9 | 0.4 | 0.4 |
| Total Wt.% Conversion | 52.5 | 49.3 | 49.0 | 46.1 |
| Wt.% Reacted | | | | |
| Toluene | 24.1 | 22.0 | 21.3 | 19.6 |
| $C_9$ Aromatics | 79.3 | 75.8 | 75.5 | 70.5 |
| $C_{10}$ Aromatics | 92.0 | 88.2 | 89.0 | 87.0 |
| $C_{11-12}$ Aromatics | 94.4 | 85.3 | 92.0 | 88.8 |
| Wt.% $C_1$–$C_5$ Made | 17.8 | 13.4 | 13.4 | 11.4 |
| Wt.% Xylenes Made | 23.0* | 22.6 | 23.2 | 23.5 |
| EXAMPLE | 4E | 4F | 4G | |
| Temperature, °F. | 751 | 698 | 828 | |
| Pressure, psig | 610 | 620 | 600 | |
| WHSV | 1.0 | 1.0 | 1.0 | |
| $H_2$/HC | 4/1 | 4/1 | 4/1 | |
| Product Distribution, Wt.% | | | | |
| $C_1$ Non Aromatics | 0.3 | 0.02 | 1.0 | |
| $C_2$'s Non Aromatics | 2.4 | 1.1 | 5.5 | |
| $C_3$'s Non Aromatics | 6.1 | 4.7 | 6.0 | |
| $C_4$'s Non Aromatics | 1.1 | 1.2 | 0.5 | |
| $C_5$'s Non Aromatics | 0.1 | 0.2 | 0.03 | |
| $C_6$'s Non Aromatics | — | 0.06 | — | |
| Benzene | 8.9 | 7.2 | 13.1 | |
| $C_7$'s Non Aromatics | — | 0.01 | 0.002 | |
| Toluene | 36.5 | 37.6 | 34.8 | |
| $C_8$'s Non Aromatics | 0.06 | 0.2 | 0.06 | |
| Ethyl benzene | 1.6 | — | — | |
| m- and p-xylene | 21.0 | 21.1* | 22.3* | |
| o-xylene | 6.7 | 5.7 | 6.7 | |
| $C_9$'s Non Aromatics | — | — | — | |
| $C_9$'s Aromatics | 13.2 | 17.4 | 8.1 | |
| $C_{10}$'s Aromatics | 1.6 | 1.3 | 0.3 | |
| $C_{11}$+ Aromatics | 0.5 | 2.3 | 1.5 | |
| Total Wt.% Conversion | 43.1 | 37.2 | 50.9 | |
| Wt.% Reacted | | | | |
| Toluene | 17.7 | 15.2 | 21.5 | |
| $C_9$ Aromatics | 66.0 | 55.4 | 79.2 | |
| $C_{10}$ Aromatics | 83.3 | 86.2 | 96.8 | |
| $C_{11-12}$ Aromatics | 84.4 | 19.6 | 53.9 | |
| Wt.% $C_1$–$C_5$ Made | 10.0 | 7.2 | 13.0 | |

TABLE VI-continued

| TRANSALKYLATION OF TOLUENE AND $C_9$-$C_{10}$ AROMATICS OVER Ni-ZSM-5 | | | | |
|---|---|---|---|---|
| EXAMPLE | 4A | 4B | 4C | 4D |
| Wt.% Xylenes Made | 22.8 | 21.9* | 24.1* | |

*XYLENES PLUS EB

EXAMPLE 5

Three comparative runs demonstrate the necessity for hydrogen in the reaction and show how the reaction over ZSM-5 differs from that of prior art acid catalysts. The runs reported below compare ZSM-5 with and without hydrogen and also compare the catalyst described in U.S. Pat. No. 3,671,602. It will be seen that in the absence of hydrogen or when using mordenite catalyst, the predominant reaction is disproportionation. The results are set out in Table VII.

TABLE VII

| | | | | | |
|---|---|---|---|---|---|
| Temp. °F. | | 698 | 700 | 700 | |
| Catalyst | | NiHZSM-5 | NiHZSM-5 | Mordenite Catalyst of No. 3,671,602 | |
| $H_2$/HC | | 0 | 4/1 | 10 | |
| psig | | 605 | 600 | 425 | |
| | Charge | | | Charge | |
| Benzene | | 1.2 | 3.8 | | — |
| Toluene | | 9.3 | 19.1 | | 6.0 |
| Xylenes | 9.5 | 18.9 | 29.6 | | 23.8 |
| $C_9$ | 69.2 | 43.9 | 27.2 | 100 | 51.0 |
| $C_{10}$ | 19.4 | 8.4 | 1.8 | $C_{10}$+ | 18.2 |
| $C_{11}$+ | 1.3 | 13.0 | 2.7 | | — |
| Ring Loss | | 8.7 | 1.2 | | — |
| Conversion | | 37.0 | 60.1 | | 49 |

EXAMPLE 6

The significance of cutting the reformate to exclude most of the $C_8$ aromatics was demonstrated by a set of runs in which the process conditions and results are summarized in Table VIII.

TABLE VIII

| EFFECT OF $C_9$+ AROMATICS | | | | | |
|---|---|---|---|---|---|
| | $C_8$+ REFORMATE | | | $C_9$+ REFORMATE | |
| EXAMPLE | 6A | 6B | 6C | 6D | 6E |
| Process Conditions | | | | | |
| Temperature, °F. | 700 | 700 | 700 | 700 | 700 |
| Pressure, psig | 425 | 425 | 425 | 600 | 600 |
| Space Velocity, LHSV | 1.5 | 1.5 | 1.5 | 0.7 | 0.7 |
| $H_2$/HC | 4 | 4 | 4 | 4 | 4 |
| Charge (Wt.%) | | | | | |
| Xylenes | 32.6 | 43.2 | 47.5 | 10 | nil |
| $C_9$+ Aromatics | 36.1 | 15.0 | 5.0 | 90 | 100 |
| $C_6$+ Non-Aromatics | 3.2 | 6.6 | 8.8 | 1 | <1 |
| Results (Wt.%) | | | | | |
| Xylenes (±) | −1.5 | −17.8 | −22.7 | +20 | +~30 |
| EB (% of $C_8$) | <----------~5 %----------> | | | | |
| $C_6$+ Non Aromatic Conversion | 94 | 95 | 94 | (not measurable) | |

Note that the higher the xylene content of the charge the lower the net xylene production. In fact, if the xylene content of the charge exceeds 30–35%, there may be a net loss of xylene.

It will be seen that the present invention provides a means for manufacture of xylenes from reformate without the expensive extraction step usually practiced and with conservation of xylenes in the reformate for use in motor gasoline.

COMMERCIAL EMBODIMENTS

The drawings illustrate advantageous process arrangements for applying the present invention to good advantage. As shown in FIG. 1, a full range naphtha is charged to a platinum reformer 10, where it is processed under conditions usual in the art. The full range reformate is transferred by line 11 to a distillation column 12 operated to take most of the $C_8$ and lighter fraction overhead by line 13 and to provide a bottoms fraction of $C_9$+ with only minor amounts of $C_8$, depending upon efficiency of the fractionation available. The $C_9$+ reformate passes by line 14 to a reactor 15 for practice of the present invention. Hydrogen is added to the charge from hydrogen recycle line 16 with addition of such make up hydrogen as may be needed at line 16. The converted product passes from a high pressure separater 17 from which excess hydrogen is taken overhead by line 16 for recycle in the process.

The liquid product, together with lower boiling material other than methane passes to fractionator 18 from which light hydrocarbons are taken overhead as gas at line 19 and benzene is removed as a side stream at line 20. The bottoms from fractionator 18, constituted almost entirely by aromatics boiling above benzene passes by line 21 to a fractionator 22. Toluene is taken overhead from column 22 by line 23 and the $C_8$+ aromatics are withdrawn as bottoms by line 24. The bottoms from column 22 are thus transferred to a fractionator 25 from which a $C_8$ aromatics stream is taken overhead for processing to desired chemicals. The bottoms of column 25 are constituted by $C_9$+ aromatics which can be recycled in the process by line 26. As shown above, it is advantageous to recycle the toluene from line 23 and the $C_9$+ fraction from line 26 back to charge of reactor 15.

Very little naphthalene has been found in the products of this reaction. If naphthalenes are introduced to the system, buildup can be prevented by taking a drag stream of column 25 bottoms through line 27.

The embodiment shown in FIG. 1 is ideally suited to an operation in which high quality gasoline meeting the needs of today's environmental restrictions can be prepared while still manufacturing BTX.

It will be apparent that the $C_8$ −fraction taken overhead from fractionator 12 by line 13 is a low boiling fraction of high octane number which is advantageously employed for blending with other motor fuel components (catalytic gasoline, straight run, gasoline, alkylate, additives and the like) to prepare a finished motor gasoline. The $C_9$+ product taken as bottoms from fractionator 25 is also a splendid motor fuel component which may be passed from line 27 to gasoline blending. This $C_9$+ product fraction has higher volatility than the $C_9$+ charge prepared by fractionator 12 and is used to advantage for motor fuel, in whole or part, depending upon the need to prepare BTX. The integration of the process of this invention is thus seen to afford a remarkably high degree of flexibility to a refinery chemical manufacturing complex.

Figure 2:
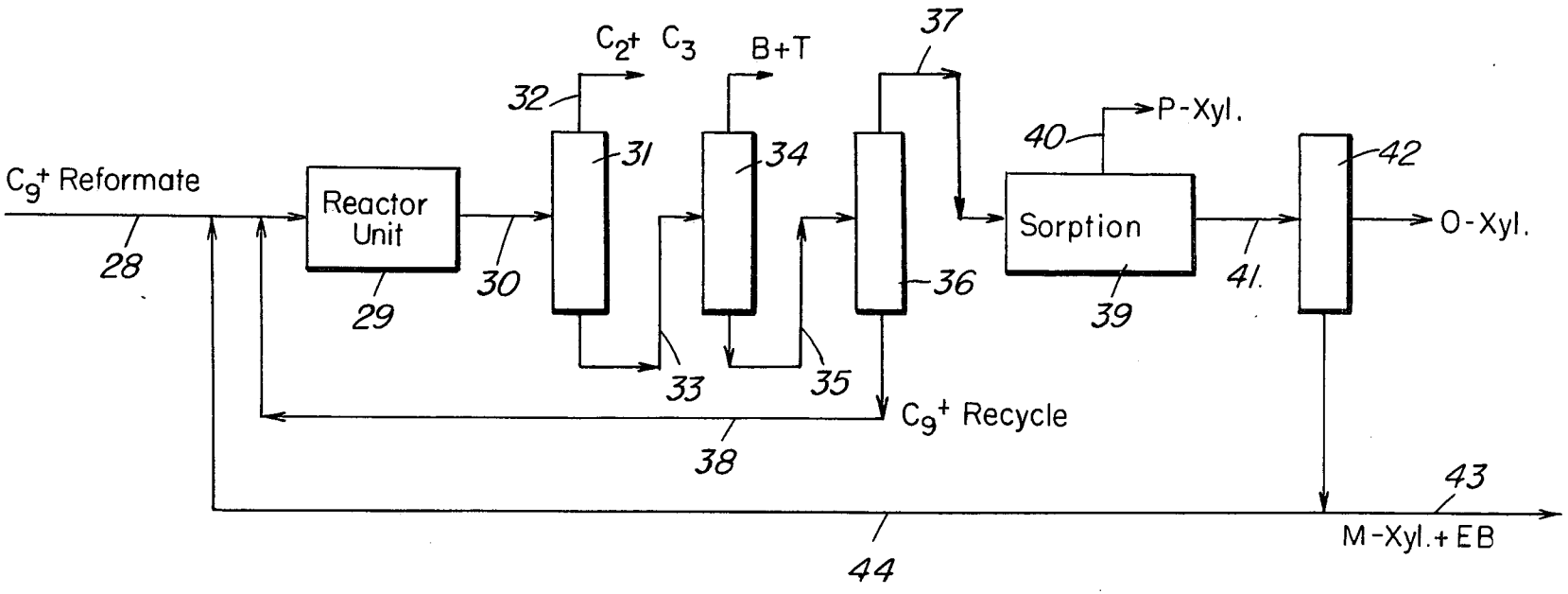
FIG. 2 is a flow sheet of processing $C_9$+ reformate to manufacture BTX in which advantage is taken of isomerization activity of the catalyst.

The catalyst used according to this invention is very effective in isomerization of $C_8$ aromatics. It thus becomes possible to include the reactor of this invention in the recovery loop for manufacture of paraxylene and alternatively orthoxylene. Such an arrangement is shown in FIG. 2 where a $C_9$+ reformate is supplied by line 28. That heavy reformate is prepared in a manner similar to the distillation in column 12 of FIG. 1. The heavy reformate passes to a reactor 29 here shown as a single process block. It will be understood that the reactor unit includes the auxiliary shown in FIG. 1 together with heat exchangers, compressors and other equipment necessary to accomplish the result. The effluent of reactor 29 passes by line 30 to a fractionator 31 from which light aliphatic components are taken overhead at line 32. The bottoms pass by line 33 to column 34 from which benzene and toluene are taken overhead and the bottoms passes by line 35 to a fractionator 36. A xylene fraction is taken overhead from column 36 by line 37 and a $C_9$+ recycle passes by line 38 back to the reactor charge.

The xylene fraction from line 37 is subjected to an operation for separation of paraxylene at 39. This may be either fractional crystallization or selective sorption as known in art. Product p-xylene is reconverted by line 40. The remaining xylenes pass by line 41 to a column 42 where orthoxylene is separated by fractional distillation.

The bottoms of column 42 are constituted by $C_8$ aromatics lean in p-xylene and o-xylene and are therefore mainly m-xylene and ethyl benzene. Those bottoms may be withdrawn by line 43 for any desired purposes but are preferably recycled in the system by line 44 to reactor 29. In reactor 29, the meta xylene is isomerized to produce additional p-xylene and o-xylene.

The results of operating such a system in different manners can be calculated. The manner of modifying the flow sheet of FIG. 2 will be apparent to one skilled in the art in order to provide the cases shown in Table IX below:

TABLE IX

PRODUCT YIELDS FROM VARIANTS OF FIGURE 2
(PARTS BY WEIGHT)

| | $C_9$+REFORMATE | $C_2$+$C_3$ | B+T | $C_9$+ RECYCLE | p-xylene | m-xylene+ EB | o-xylene |
|---|---|---|---|---|---|---|---|
| CASE A | | | | | | | |
| No xylene recycle | 68 | 14 | 23 | 32 | 7 | 16 | 7 |
| CASE B | | | | | | | |
| o- and p-xylene recovered, balance recycled | 37 | 7 | 16 | 47 | 7 | 16 | 7 |
| CASE C | | | | | | | |
| p-xylene recovered, balance recycled | 19 | 4 | 8 | 58 | 7 | 23 | — |

The three flow sheets of FIG. 3 provide graphical comparisons of conventional manufacture of BTX from reformate with two alternative approaches to commercial application of the present invention. FIG. 3A represents the process scheme now widely followed in commercial production of BTX. A light naphtha which includes the $C_6$ hydrocarbons of the distillate from crude and having an end point less than 300°F. is subjected to catalytic reforming. The naphtha is cut at an end point which avoid introduction of $C_9$ or heavier aromatics.

The light naphtha is reformed in platinum reformer 45 to dehydrogenate the naphthenes to aromatics. The reformate is fractionated in column 46 and the material boiling below about 150°F. is taken overhead to provide a bottoms fraction boiling between 150°–300°F. That material is charged to a solvent extraction unit 47 wherein aromatics are separated from the aliphatic compounds. The extraction is reasonably efficient but does leave some non aromatics in the extract which is transferred by line 48 to distillation for separation into benzene, toluene and $C_8$ aromatics. The xylenes are recovered from the latter by the known techniques of selective sorption or fractional crystallization with isomerization of the material from which a desired xylene has been separated. The $C_8$ fraction of the material withdrawn by line 48 normally contains about 15 to 18% of ethyl benzene, a troublesome component in xylene separations. This should be contrasted with the low levels of ethyl benzene reported above for operation in accordance with this invention.

FIG. 3B utilizes the new technology provided by this invention in a system to increase the amount of BTX derived from operation of a single reformer. In this case, full range naphtha is charged to platinum reformer 49. The reformate is fractionated in column 50 to separate a light overhead in line 51 comprised mainly by non aromatic hydrocarbons. A light aromatic reformate boiling between 130° and 300°F. is transferred by fractionator 50 by line 52 and subjected to solvent extraction in extractor 53. The extracted aromatics are handled in the same manner as in FIG. 3A. The heavy reformate, boiling above about 300°F. is transferred by line 54 to reactor 55 in which it is converted in the manner described hereinabove to generate additional BTX. The product is fractionated in a system indicated generally by 56 and unreacted heavier aromatics are recycled by line 57.

The flow sheet of FIG. 3C illustrates the preferred embodiment of this invention in which the high volatility reformate containing BTX formed during reforming is utilized to best advantage in manufacture of gasoline. The full range naphtha reformed in reformer 58 passes to fractionator 59. Light hydrocarbons, are taken overhead by line 60 to be used for pressuring gasoline, bottled gas and the like. The $C_5$–360°F. fraction is a highly aromatic gasoline blending stock of relatively low boiling point, desirable for making high volatility, high front end octane number gasoline. This fraction passes by line 61 to gasoline blending facilities. The heavy end of the reformate (360°F.+) is reacted in converter 62 in accordance with the present invention to manufacture BTX. The 300°F.+ product is recycled by line 63.

We claim:

1. In the manufacture of gasoline and concurrent production of chemical grade aromatic compounds of eight or less carbon atoms by catalytic reforming of naphtha and using part of the reformate for each purpose, the improvement resulting in higher quality gasoline of lower "heavy end" content, which comprises fractionating a catalytic reformate to provide a light reformate containing most of the $C_8$ and lighter components of the reformate and a heavy reformate which contains no more than 20 weight percent of xylenes, blending said light reformate with other motor fuel components to provide a finished gasoline, contacting said heavy reformate with a catalyst characterized by an effective amount of type ZSM-5 zeolite, zeolite ZSM-12 or zeolite ZSM-21 under conditions to remove from alkyl aromatics side chain alkyl groups of greater than one carbon atom and produce therefrom aliphatic hydrocarbons containing more carbon atoms than the side chains so removed and to produce more xylenes then contained in said heavy reformate and to also produce benzene and toluene, said conditions being about 550° to about 1000°F., about 100 to about 2000 pounds per square inch, about 0.5 to 10 mols of hydrogen per mol of hydrocarbon and a weight hourly space velocity between about 0.1 and about 200 unit weights of hydrocarbon per unit weight of said zeolite in the catalyst per hour, and recovering from the product of contacting said heavy reformate with said catalyst aliphatic hydrocarbons having a greater number of carbon atoms than the side chains of alkyl aromatics in said heavy reformate and at least one aromatic hydrocarbon of eight or less carbon atoms in an amount greater than quantity of said aromatic hydrocarbon in said heavy reformate.

2. The process of claim 1 wherein said heavy reformate charge includes a minor amount of eight carbon atom aromatics and is essentially free of aromatics having less than eight carbon atoms.

3. The process of claim 1 wherein said zeolite is at least partially in the acid form.

4. The process of claim 1 wherein said zeolite is composited with a porous matrix.

5. The process of claim 4 wherein the matrix is present in the composite in an amount less than the amount of said zeolite.

6. The process of claim 1 wherein the operating conditions range from about 0.5 to 10 WHSV.

7. The process of claim 1 wherein said catalyst includes a hydrogenation metal.

8. The process of claim 7 wherein said metal is nickel.

9. The process of claim 3 wherein said catalyst includes a hydrogenation metal.

10. The process of claim 9 wherein said metal is nickel or cobalt.

11. The process of claim 4 wherein said matrix is porous alumina and said zeolite is nickel, acid zeolite ZSM-5 or cobalt, acid zeolite ZSM-5.

12. A process for producing aromatic compounds of six to eight carbon atoms from an aromatic hydrocarbon charge predominantly higher in molecular weight than eight carbon atom aromatics, without substantial formation of heavier (350°F.+) aromatics through conventional disproportionation or transalkylation reactions, which process comprises fractionating an aromatic naphtha to remove therefrom a substantial amount of $C_8$ aromatics together with lower boiling components of said naphtha and thereby produce said charge with a catalyst characterized by an effective amount of type ZSM-5 zeolite, zeolite ZSM-12 or zeolite ZSM-21 under conditions to remove from alkyl aromatics side chain alkyl groups of greater than 1 carbon atom and produce therefrom aliphatic hydrocarbons containing more carbon atoms than the side chains so removed and to produce more xylenes than contained in said heavy reformate and to also produce benzene and toluene, said conditions being about 550° to about 1000°F., about 100 to about 2000 pounds per square inch, about 0.5 to 10 mols of hydrogen per mol of hydrocarbon and at a weight hourly space velocity between about 0.1 and about 200 unit weights of hydrocarbon per unit weight of said zeolite in the catalyst per hour and recovering from the product of contacting said charge with said catalyst aliphatic hydrocarbons having a greater number of carbon atoms than the side chains of alkyl aromatics in said heavy reformate and at least one aromatic hydrocarbon of eight or less carbon atoms in an amount greater than quantity of said aromatic hydrocarbon in said heavy reformate.

13. The process of claim 12 wherein said charge includes a minor amount of eight carbon atom aromatics and is essentially free of aromatics having less than 8 carbon atoms.

14. The process of claim 12 wherein said charge is a heavy reformate.

15. The process of claim 12 wherein said charge is a heavy pyrolysis gasoline.

16. The process of claim 12 wherein said zeolite is at least partially in the acid form.

17. The process of claim 12 wherein said zeolite is composited with a porous matrix.

18. The process of claim 12 wherein the operating condition range is from about 0.5 to 10 WHSV.

19. The process of claim 17 wherein the matrix is present in the composite in an amount less than amount of said zeolite.

20. The process of claim 12 wherein said catalyst includes a hydrogenation metal.

21. The process of claim 20 wherein said metal is nickel or cobalt.

22. The process of claim 16 wherein said catalyst includes a hydrogenation metal.

23. The process of claim 22 wherein said metal is nickel or cobalt.

24. The process of claim 17 wherein said matrix is porous alumina and said zeolite is nickel, acid zeolite ZSM-5 or cobalt, acid zeolite ZSM-5.

25. The process of claim 1 wherein $C_9$+ aromatics are separated from said product and admixed with said heavy reformate for contact with such catalyst.

26. The process of claim 1 wherein $C_9$+ aromatics and toluene are separated from said product and admixed with said heavy reformate for contact with said catalyst.

27. The process of claim 1 wherein said heavy reformate contains no more than 10 weight percent of xylenes.

28. The process of claim 12 wherein $C_9$+ aromatics are separated from said product and admixed with said charge for contact with said catalyst.

29. The process of claim 12 wherein $C_9$+ aromatics and toluene are separated from said product and admixed with said charge for contact with said catalyst.

30. The process of claim 12 wherein said charge contains no more than 10 weight percent of xylenes.

31. The process of claim 1 wherein a xylene fraction is separated from said product, a desired xylene isomer is isolated from said xylene fraction and the resultant mixture of xylenes lean in said desired isomer is recycled to contact with said catalyst in admixture with said heavy reformate.

32. The process of claim 12 wherein a xylene fraction is separated from said product, a desired xylene isomer is isolated from said xylene fraction, and the resultant mixture of xylenes lean in said desired isomer is recycled to contact with said catalyst in admixture with said charge.

33. The process of claim 1 wherein at least a portion of the said product after recovery therefrom of aromatics of eight or less carbon atoms is blended with other motor fuel components to make a motor gasoline.

* * * * *

UNITED STATES PATENT AND TRADEMARK OFFICE

CERTIFICATE OF CORRECTION

PATENT NO. : 3,945,913

DATED : March 23, 1976

INVENTOR(S) : JAMES A. BRENNAN and ROGER A. MORRISON

It is certified that error appears in the above-identified patent and that said Letters Patent are hereby corrected as shown below:

| | |
|---|---|
| Column 17, line 63 | after "charge" insert --,contacting said charge-- |

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*